US005249992A

United States Patent [19]

Schneider

[11] Patent Number: 5,249,992

[45] Date of Patent: Oct. 5, 1993

[54] MARINE PROPULSION UNIT WITH CONTROLLED CYCLIC AND COLLECTIVE BLADE PITCH

[75] Inventor: William E. Schneider, Annapolis, Md.

[73] Assignee: The United States of America as represented by the Secretary of the Navy, Washington, D.C.

[21] Appl. No.: 998,293

[22] Filed: Dec. 30, 1992

[51] Int. Cl.[5] ..... B63H 3/00

[52] U.S. Cl. ..... 440/50; 114/330; 416/164

[58] Field of Search ..... 440/50, 6; 114/330; 416/164, 170 R, 156

[56] References Cited

U.S. PATENT DOCUMENTS

| | | | |
|---|---|---|---|
| 2,714,866 | 8/1955 | Pleuger et al. | 416/170 |
| 2,727,485 | 12/1955 | Combs | 416/170 |
| 2,850,106 | 9/1958 | Swan | 440/50 |
| 3,101,066 | 8/1963 | Haselton | 114/330 |
| 3,291,086 | 12/1966 | Haselton | 114/330 |
| 3,295,609 | 1/1967 | Jayne | 170/149 |
| 3,323,598 | 6/1967 | Lindahl | 170/160.25 |
| 3,450,083 | 6/1969 | Haselton et al. | 114/330 |
| 3,914,629 | 10/1975 | Gardiner | 440/6 |
| 4,648,345 | 7/1987 | Wham et al. | 440/50 |
| 4,744,727 | 5/1988 | Muller | 416/164 |
| 5,028,210 | 7/1991 | Peterson et al. | 440/50 |

OTHER PUBLICATIONS

Richard S. Brannin, "Tandem Propellers: A New Concept for DSV".

Advanced Rotot Technology Research Association, Kawasaki Heavy Industries, Ltd., "Varivec Propeller" (Advertisement), May 1988.

D. W. Brown et al., "Submersible Outboard Electric Motor/Propulsor," Naval Engineers Journal, Sep. 1989, pp. 44–52.

Nanba et al, "Development of Variable Vector Propeller (1st Report)," Journal of the Kansai Society of Naval Architects, Japan, No. 210 Sep. 1988.

*Primary Examiner*—Jesus D. Sotelo

*Attorney, Agent, or Firm*—Howard Kaiser; Charles D. Miller

[57] ABSTRACT

An integral marine propulsion unit utilizes both collective and cyclic propeller blade pitch angle variations to generate a thrust vector in any of three degrees of motion for use with both the submersible and surface marine vessels. The present marine propulsion unit eliminates the need for extraneous drag generating control surfaces and rudders for motion control of a marine vessel by incorporating a flat plate mechanism which includes an Oldham coupler coupled to a pair of plates and a slotted plate coupled with one of the plates. The slotted plate and the one plate coupled to the slotted plate are relatively rotatable about a fixed axis. The flat plate mechanism permits relative angular displacement between the slotted plate and the one plate to collectively pivot all of the propeller blades and permits radial movement of the slotted plate along with propeller blades.

15 Claims, 5 Drawing Sheets

MARINE PROPULSION UNIT WITH CONTROLLED CYCLIC AND COLLECTIVE BLADE PITCH

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

This invention relates to an improved marine impeller type propulsion unit which operates under water for motion control of a marine vessel in multiple degrees of freedom.

2. Description of the Prior Art

Most marine craft presently are propelled and controlled by single fixed propulsion devices such as screws and control surfaces. This limits the placement of shipboard internal propulsor machinery that drives the propeller and requires additional drag producing motion control appendages such as rudders and diving planes. Other marine crafts use alternate mechanical propulsors that change a propeller's cyclic and collective blade pitch that in turn generates thrust vectors to produce up to three degrees of freedom (up/down, right/ left, forward/reverse). U.S. Pat. No. 3,101,066 issued to Haselton, et al., for example, discloses a propulsor unit which uses a swash plate for the pitch control mechanism. This type of propulsors are used as ship secondary propulsors that use Voith-Schneider propeller (vertical axis propeller) and underwater submersibles. Particular means of mechanically varying the propeller blade pitch includes a swash plate ring that floats on rubber or steel spring mounts to permit freedom of movement when actuators push and/or pull the ring along the axis of rotation and when the ring is angled to the axis of rotation.

Limitations and disadvantages of the system disclosed in U.S. Pat. No. 3,101,066 include: (1) "lacking durability" and exhibiting "much lost motion", as described in Hazelton's later U.S. Pat. No. 3,450,083; (2) limited use to tandem propeller type propulsion configuration that precludes its use on other marine vessels such as a surface vessel; (3) the ring on a propulsion motor as shown does not incorporate both the swash plate control mechanism and actuator means in the central bore section of the motor that makes for an integral propulsion unit; and (4) the floating swash plate ring requires a large open bore structure for its placement which induces lost motion.

U.S. Pat. No. 3,450,083 discloses an improvement of the system described in U.S. Pat. No. 3,101,066. It discloses an improved way of supporting the swash plate ring which controls the cyclic and collective pitch of the propellers with an internal ring gear drive mechanism. Limitations and disadvantages of this system include: (1) the use of rotating seals in the drive motors to prevent leakage; (2) the need for a conventional in-line motor for driving the hull gear drive unit, thus requiring more internal marine vessel space; and (3) limited to use in a tandem propeller type propulsion configuration that precludes its use on other marine vessels such as a surface vessel.

Other propulsion units include Kawasaki Heavy Industries's Varivec propeller unit which consists of a swash plate, that is actuated by servo-actuators, which alters each propeller blade's combined cyclic and collective pitch that can generate thrust in any direction. Limitations and disadvantages of this unit include: (1) the need for a rotating shaft seal on the electric motor; and (2) an in-line electronic motor/speed reducer unit that requires more internal vessel space, thus limiting the flexibility for drive unit placement on a marine vessel.

U.S. Pat. No. 5,028,210 issued to Peterson, et al., describes an improved marine impeller type propulsion unit, the disclosure of which is incorporated herein by reference. U.S. Pat. No. 5,028,210 discloses a marine propulsion unit secured to an exterior of a marine hull, which is driven by a ring shaped prime mover defining a central bore section with a central axis. A plurality of propulsion blades radially extend from a hub which rotates about the central axis. Each of the blades is independently capable of pivotal movement, whereby the pitch angle thereof is adjusted selectively to provide pitch, yaw and fore/aft motion to the hull. A swash plate mechanism is mounted within the hub and to an inner central axle which is concentrically situated with the hub to control the blade pitch, collectively and cyclically, during the rotation of the hub. The swash plate mechanism is securely supported by an axially movable cylindrical support bearing which is connected to the central axle. A plurality of actuators are disposed within the central bore and around the central axle and are attached to the swash plate mechanism. By simultaneously actuating all the actuators in the same direction, the entire swash plate can be moved in the axial direction about the cylindrical support bearing to collectively change the pitch of the blades. On the other hand, to cyclically change the pitch of the blades, only some or all are actuated in different directions to tilt the swash plate in the desired direction.

In U.S. Pat. No. 5,028,210, the propeller shaft which drives the hub is equipped with a channel which engages a first scissor bearing located at the perimeter of the swash plate to rotate the swash plate about a water lubricated U-shaped bearing housed in the bearing pad which in turn is supported on the cylindrical support bearing. A second scissor bearing is operatively connected to the bearing pad to prevent rotation of the bearing pad caused by the frictional drag of the swash plate. While the second scissor bearing is supported so as to prevent a rotational movement about the cylindrical support bearing, it permits movement in the axial direction. This allows the link arm, which is used to rotate the blade, without having to carry the rotational load.

SUMMARY OF THE INVENTION

Accordingly, the primary object of the present invention is to provide an improved electro-mechanical marine propeller unit for varying the pitch angle of a plurality of propeller blades cyclically and/or collectively during the rotation thereof.

Another object of the present invention is to make an improved integral marine propulsion unit using a flat plate mechanism, which is radially and rotationally movable for cyclic and collective pitch angle adjustments and whereby all components operate in ocean ambient conditions.

Another object of the present invention is to eliminate drag producing control surfaces and rudders for motion control of a marine vessel by using a marine propeller unit which can vary the pitch angle of a plurality of propeller blades cyclically and/or collectively during the rotation thereof.

Another object of the present invention is to eliminate the need for a prime mover that is in-line to a swash plate mechanism, thus decreasing the overall size and weight of the propeller unit.

Another object of the present invention is to eliminate the need for a rotating shaft seal passing through a marine pressure hull or prime mover unit.

Another object of the present invention is to provide an improved marine propeller unit that allows for a greater flexibility of a marine vessel's propulsion configuration.

Still another object of the present invention is to provide a more energy efficient marine propulsion unit by eliminating thrust bearing losses and minimizing lost motion.

The above identified and other objects of the invention are achieved by using a marine propulsion unit which is secured exteriorly to a marine hull, which is driven by a ring shaped prime mover defining a central bore section with a central axis. A hub rotates about the central axis and carries propulsion blades which are equally spaced about the perimeter of the hub. Each of the blades radially extends from the hub and is independently pivotable about the hub, whereby the pitch angle thereof is adjusted selectively to provide pitch, yaw, and fore/aft motion to the hull. A flat plate mechanism is mounted within the hub and in the general vicinity of the prime mover to control the blade pitch, collectively and cyclically, during the rotation of the hub.

The flat plate mechanism is securely supported by a radially movable cylindrical support shaft proximal to the centerline of the prime mover. The flat plate mechanism includes a slotted plate having slots, each of which engages one of the propellers, and an inner drive plate. The slotted plate is relatively rotatable with respect to the inner drive plate. By shifting the relative position of the slotted plate in the angular direction with respect to the inner drive plate, the pitch of all the blades can be collectively changed as the hub rotates. By radially moving the cylindrical support shaft which supports the flat plate mechanism, thereby eccentrically offsetting the flat plate mechanism, the pitch of the blades can be selectively or cyclically changed as the hub rotates. At least two independent actuators are used to move the flat plate mechanism and the cylindrical support shaft to control the collective and cyclic pitch changes.

BRIEF DESCRIPTION OF THE DRAWINGS

These and other objects of the invention will become more readily apparent in the ensuing specification when taken together with the drawings.

DESCRIPTION OF THE PREFERRED EMBODIMENTS

Figure 1A:
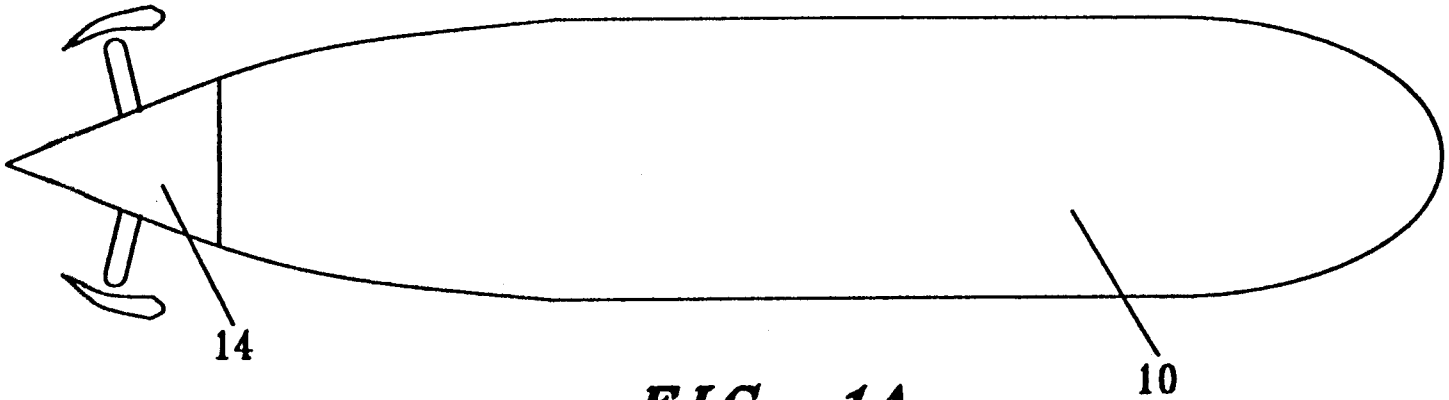
FIG. 1A is a schematic diagram of a submersible marine vessel equipped with the improved propeller unit of the present invention.

The present invention has been described and illustrated in terms of two specific embodiments. Same or equivalent elements of the embodiments illustrated in the drawings have been identified with same reference numerals.

The embodiments described herein have been contemplated for purposes of illustrating the principles of the present invention. Accordingly, the present invention is not to be limited solely to the exact configuration and construction as illustrated and set forth herein.

Figure 1B:
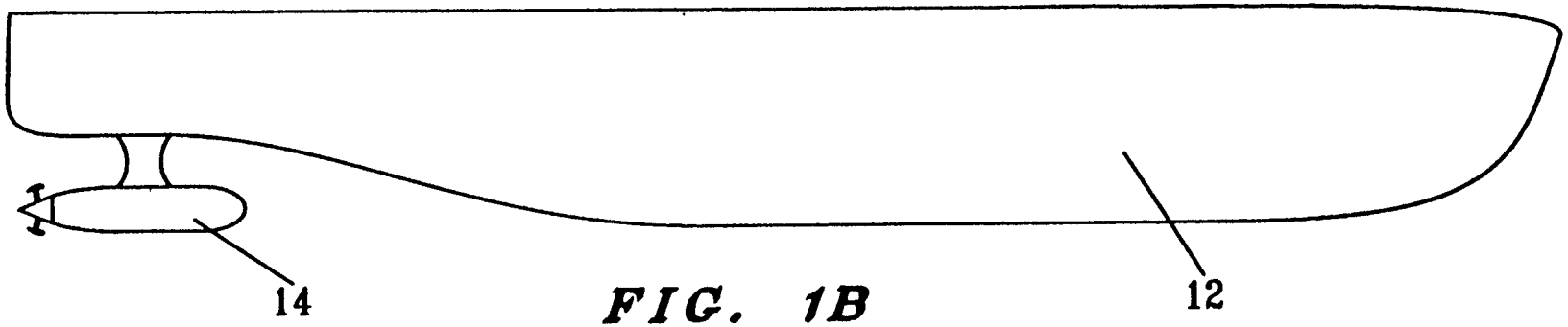
FIG. 1B is a schematic diagram of a surface marine vessel equipped with the improved propeller unit of the present invention.

FIGS. 1A and 1B show perspective views of marine applications where the propeller unit 14 as presently disclosed is used on a submersible craft 10 or a surface vessel 12.

The operating principles of the propeller unit 14 of the present invention are disclosed in U.S. Pat. No. 5,028,210, the disclosure of which is incorporated herein by reference. In principle, the propeller unit of the present invention is similar to that of a helicopter rotor where during normal operation, the unit will rotate at constant speed and direction. The unit 14 utilizes both collective and cyclic pitch angle variations to generate a thrust vector in any of three degrees of motion, i.e., translational movement of fore-aft, yaw and pitch. By definition, the pitch angle refers to an angle at which the propeller blade 18 forms with the tangent of circle of rotation. The cyclic pitch controls magnitude and direction of the transverse thrust that is perpendicular to the longitudinal axis of the marine vessel. The propeller unit 14 can vary in both magnitude and point on the circle of rotation at which the peak cyclic pitch magnitude occurs. For example, with pure collective pitch variation, each blade's pitch angle is equal during the propeller rotation that in turn imparts either a forward, reverse or no propulsive thrust to a marine vessel. With cyclic pitch variation, each blade's angle continually varies with respect to the circle of rotation's tangent. With the propeller blades in a neutral collective thrust position, cyclic pitch changes can effect transverse thrust without disturbing forward or reverse motions. When the collective pitch is superimposed on the cyclic pitch, all three degrees of motion are possible from a sole propeller unit 14. All these motions can be generated without the need for conventional control surfaces such as rudders and/or diving planes.

Figure 2:
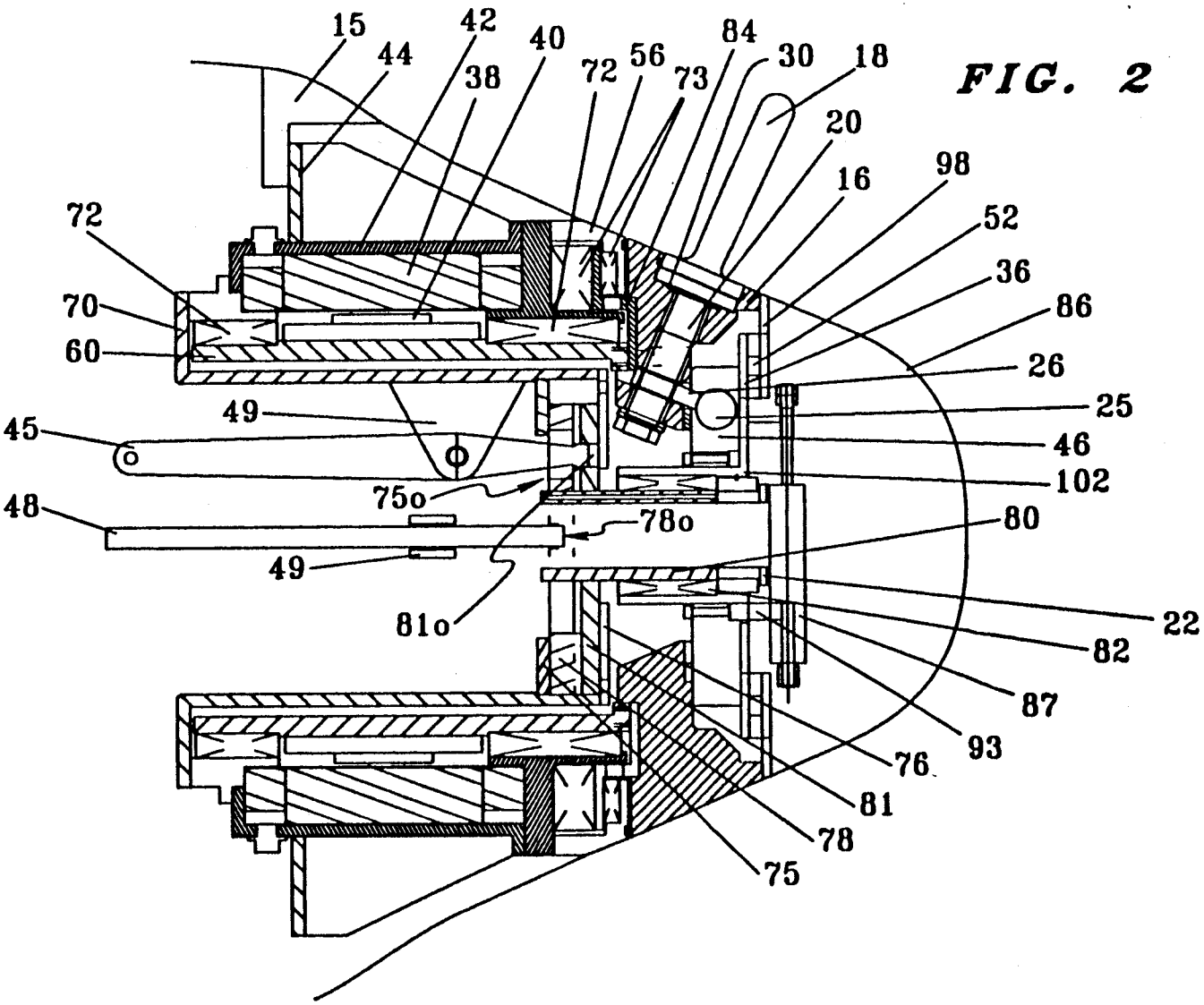
FIG. 2 is a cross sectional view of a first embodiment of the propeller control mechanism according to the present invention.

FIG. 2 shows one embodiment of the propeller unit 14 according to the present invention, which is attached to a cowling structure 15. The propeller unit 14 comprises a propeller hub 16 having a diameter substantially equal to the cross sectional diameter of the prime mover 38, 40. Propeller blades 18 are pivotally mounted in the hub 16 at equal angular spacing and each propeller blade is mounted for pivotal motion on a propeller pivot shaft 20, the axis of each blade being perpendicular to the conical aft section of the hub. The pivot shaft 20 penetrates the hub 16 which supports a conventional bearing bore support mechanism 30. The pivot shaft 20 is fitted with a crank arm 26 which contacts through a ball 25, a slot in the slotted plate 46 which is positioned on a cylindrical shaft 102 of the inner drive plate 36.

Rotation of the propeller blades 18 simultaneously with the hub 16 for propulsion of a marine vessel is accomplished by an open bore permanent magnet, brushless DC torque motor 38, 40 that operates with all components exposed to ocean ambient conditions. This type of motor can operate at relatively slow speeds and high output torques which produce efficient propeller operation. The motor armature 38 is an epoxy encapsulated stator unit that comprises a laminated stator core and multiphased motor windings. For deep ocean applications, the armature is preferably enclosed in an oil filled pressure compensated housing. A motor rotor 40 comprising a banded permanent magnet section is attached to a backing ring which in turn is keyed to a propeller shaft 60 to directly transmit torque. The propeller shaft 60 is rigidly attached to the hub 16 which rotates along with the propeller blades 18. An armature axial clamping housing 42, which is fixedly attached to the propeller unit support framing 44, maintains the motor armature 38 stationary and axially aligns with the motor rotor 40. Alternatively, the rotor 40 may be anterior to the stator and have an enlarged propeller tube 60 so as to surround and directly couple with the rotor 40.

The stationary motor housing support tube 42 which is rigidly attached to the propeller unit support framing 44 rotationally supports the propeller shaft 60. Thrust and relative motion between the propeller shaft 60 and motor support tube 42 is provided by radial bearings 72 and thrust bearings 73. Relative rotational motion between the flat mechanism, which comprises an inner drive plate 36, a slotted plate 46 and an Oldham ring 52, and a fixed inner support shaft 80 is provided by radial bearings 82. Specifically, the inner drive plate is fixed to an inner drive plate shaft 102 which is concentrically situated over the fixed inner support shaft 80 with the radial bearings 82 therebetween. The inner support plate and the inner support plate shaft may be integrally formed or attached in any conventional manner.

The bearing plate 84 which is fixed to the hub 16 and held between the thrust bearings 73 axially and radially supports the hub 16 for rotational movement relative to the cowl 15. The thrust bearings 72 and 73 are positioned in the motor housing 42 with the bearing support housing 56. The fairwater cap 86 is attached to the end of the propeller hub 16.

As shown in FIG. 2, transferring rotary motion of the propeller shaft 60 to the slotted plate 46 is accomplished by the outer drive plate 98 that is secured to the hub 16, the Oldham coupling ring 52 and the inner drive plate 36. The Oldham ring 52 is engaged with the outer drive plate 98 and the inner drive plate 36 As the propeller shaft and outer drive plate 98 rotate, the key on the Oldham ring 52 is driven from the slot in the outer drive plate 98. The Oldham ring 52 transfers the rotational motion to the inner drive plate 36 which in turn transmits to the slotted plate 46 via double acting hydraulic actuators 87 which couple the slotted plate and inner drive plate. The hydraulic actuators 87 are used to maintain and change the relative angular position between the inner drive plate 36 and the slotted plate 46 to cause the collective pitch change.

Figure 3:
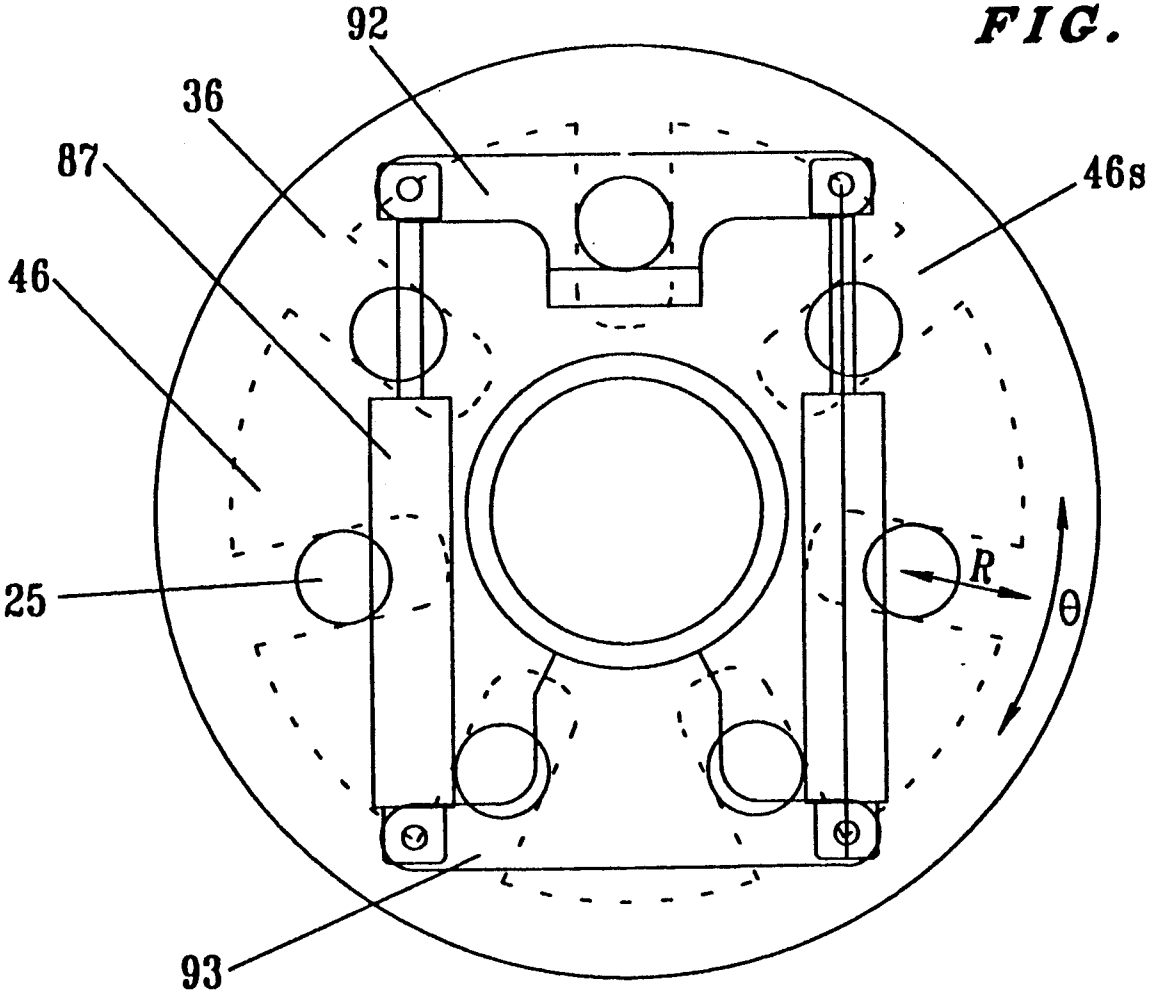
FIG. 3 is an end view (right side) of FIG. 2 showing the slotted plate and hydraulic control cylinders for controlling the collective pitch.

The actuators 87 are mounted to a bracket 92 which is mounted to the inner drive plate 36 and a bracket 93 which is mounted to the slotted plate 46. The ends of the actuators are pivotally mounted to the brackets 92, 93. The actuators 87 are mounted in parallel such that one is made to extend and the other to contract to angularly rotate the slotted plate 46 with respect to the inner drive plate 36 and the hub 16. As more clearly shown in FIG. 3, the slotted plate 46 has a plurality of radially formed slots 46*s* which are spaced apart at the same angular intervals. Each of the balls 25, which is fixed to the crank arm 26 which in turn is fixed to the shaft 20, is positioned within one of the slots 46*s*. The slots are dimensioned to permit no substantial free relative movement in the rotational or angular direction $\theta$ between the ball and the respective slot, but permit the balls to slide radially R of the slots. When the slotted plate is angularly displaced from the inner drive plate 36, since the ball is relatively fixed to the slot in the angular direction with respect to the slotted plate, the ball 25 rotates along with the slotted plate to thereby cause the crank arm 26 and thus the shaft 20 to pivot about the axis of the shaft 20. The rotation of the slotted plate 46 about the inner plate 36 causes all of the shafts 20 to rotate by an equal amount,and thus collectively change the pitch of the blades 18 equally. The actuators may be any conventional hydraulic cylinder operated from an external operator controlled source. A conventional rotary hydraulic joint 22 may be used to communicate with the source. Alternatively, the actuators can include electric linear actuators with screw drives, permanent magnetic linear actuators, pneumatic cylinder units or a rotating mechanical linkage.

The propeller blade pitch must be changed in relation to the angular position of the hub 16 for pitch and yaw control. In the first embodiment of the present invention, the cyclic control is achieved by displacing the inner support tube 80 from the center line of the hub 16. This displacement also offsets the slotted plate 46 and inner drive plate 36, but does not offset the angular setting between the slotted plate with respect to the inner drive plate, thereby maintaining the same angular relationship therebetween. As a result of the offset, the slotted plate will rotate eccentrically with the hub. This eccentricity is translated to an eccentric transmission of motion from the slots in the slotted plate to the ball 25 at the end of the propeller blade crank arm 26. The eccentric motion is further translated through the crank arm 26, the propeller blade shaft 20, and into the propeller blade 18 itself. The offset position of the inner support shaft 80 controls the pitch and/or yaw pitch angles of the propeller blades. The distance of offset controls the magnitude of those angles.

The inner support shaft 80 is mounted to the outer support tube 70 via a conventional circular, non-rotating, static Oldham ring 78. As better shown in FIG. 4, which shows the static Oldham ring 78 having a bottle-shaped opening 78*o*, and a circular plate 81 behind the Oldham ring 78. The static Oldham ring 78 contains keys 78*a* and 78*b* extending from opposite faces thereof. The keys 78*a*, 78*b* are offset or phased by 90 degrees with respect to each other. The plate 81 has a key slot 81*a* that engages with the key 78*a* of the Oldham ring 78 to permit pitch movement P of the plate 81 relative to the Oldham ring 78. That is, the key 78*a* and slot 81*a* act as a guide for pitch movement P, and the bottle shaped opening 78*o* permits the plate 81 to move relative to the Oldham plate without moving the Oldham ring 78, or vice-versa. The plate 81 is fixed to the inner support shaft 80.

A plate 75 (not shown in FIG. 4) generally having a circular central opening 75*o* has a key slot (not shown) that mates with the key 78*b* on the opposite face of the Oldham ring 78 to permit the Oldham ring to move relative to the plate 75 in the yaw direction Y. The plate 75 is fixed to the end of the outer support tube 70. A clamping plate 76 is used to maintain the plate 75, the Oldham ring 78 and the plate 81 in contact. This arrangement permits the center of the inner support shaft 80 to be displaced from the centerline of the hub 16.

A pair of pivot brackets 49 are fixed to the inner diameter of the outer support tube 70 and spaced apart by 90 degrees to provide pivot points for the pitch lever 45 and the yaw lever 48. The end of the pitch lever 45 is operatively situated in an opening 81*o* (FIG. 2) formed in the plate 81. The pitch lever 45 extends through the opening 75*o* in the plate 75 and through the bottle shaped opening 78*o* in the Oldham ring 78 so that the lever 45 can be moved without interference therefrom. The end of the yaw lever 48 is operatively situated in an opening 78*o* (FIG. 2) formed in the Oldham ring 78. The yaw lever 48 extends through the opening 75*o* in the plate 75 so that the lever 48 can be moved without interference therefrom.

Actuation of the pitch lever 45 moves the plate 81 in the pitch direction P, which in turn moves the inner support shaft 80, along with the flat plate mechanism 36, 46, 52 to effect a pitch blade change, without moving the Oldham ring 78. Actuation of the yaw lever 48 moves the Oldham ring 78 in the yaw direction Y, which in turn moves the plate 81 and the inner support shaft 80, which in turn moves the flat plate mechanism 36, 46, 52 to effect a yaw blade change. The levers 45, 48 may be actuated by any conventional motion mechanisms such as electric linear actuators with screw drives, permanent magnetic linear actuators, pneumatic or hydraulic cylinders or mechanical linkages, or as shown in FIG. 5.

Figure 5A:
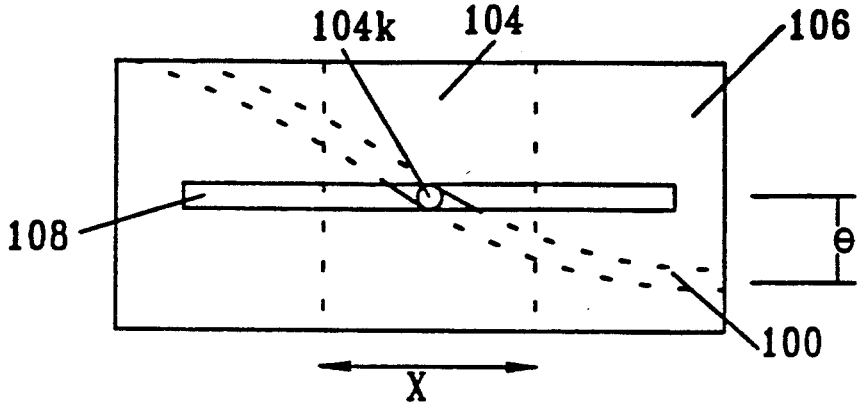
FIG. 5A shows a schematic diagram of the collective pitch change mechanism in the second embodiment.
Figure 5:
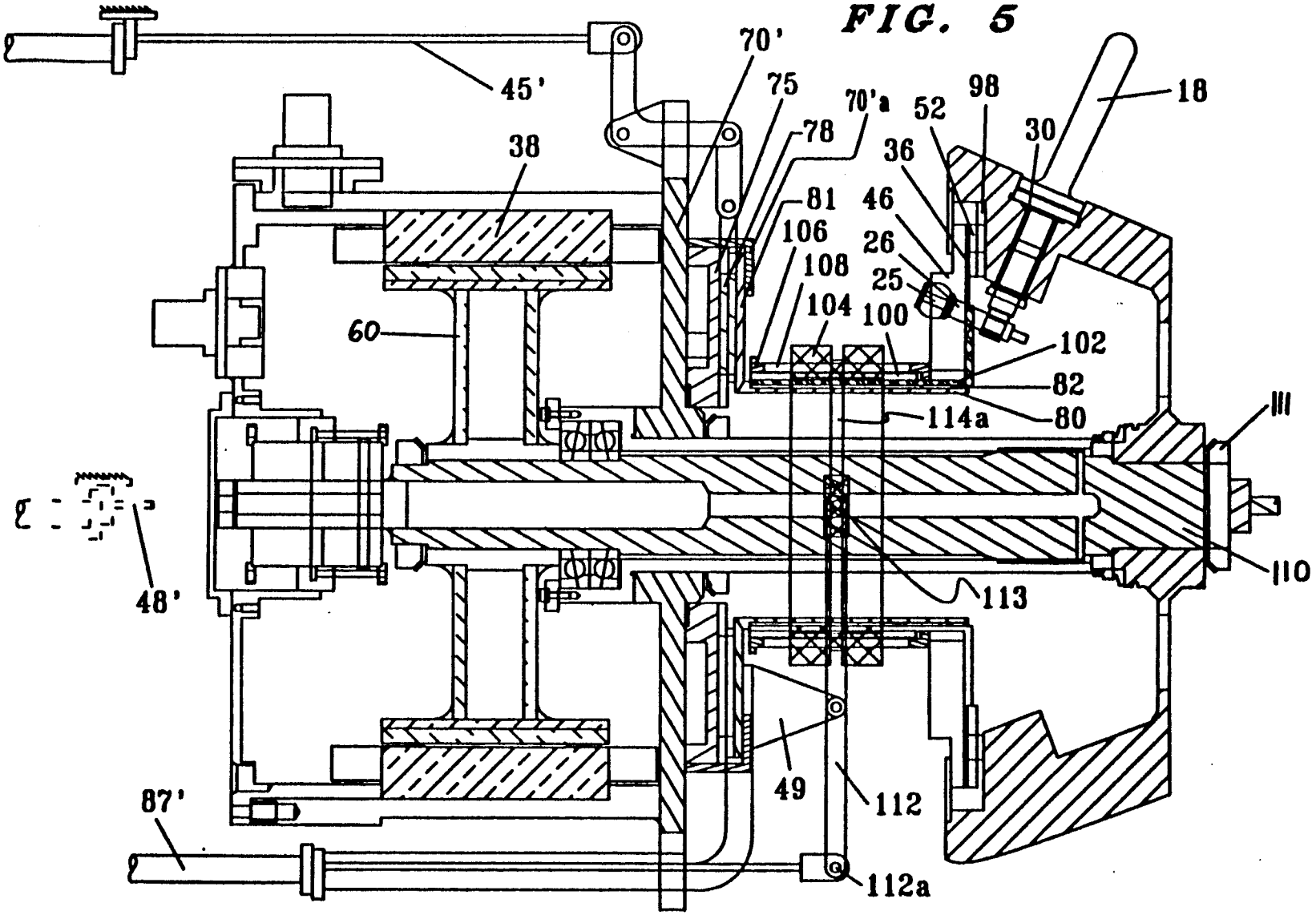
FIG. 5 is a cross section view of a second embodiment of flat plate propeller control mechanism according to the present invention configured for a conventional shaft type drive motor.

FIG. 5 shows the second embodiment of the propeller unit 14 according to the present invention which is similar to the first embodiment, except that the collective pitch change is carried out in a different manner. Specifically, the rotor 40 of the prime mover is operatively connected to the propeller shaft 60. The hub 16 is radially and axially aligned and fixedly held in place to the end of the central shaft 110 by a locking device 111 such as a locknut. The outer drive plate 98 is secured to the hub 16 and transmits power to the inner drive plate 36 via the Oldham coupling ring 52. As the propeller shaft and outer drive plate 98 rotate, the key on the Oldham ring 52 is driven from the slot in the outer drive plate 98. The Oldham ring 52 transfers the rotational motion to the inner drive plate 36 which in turn transmits to the slotted plate 46, as in the first embodiment.

In the second embodiment, the actuators 87 (first embodiment) which cause the slotted plate 46 to rotate with respect to the inner drive plate 36 are omitted. Instead, a helically shaped key slot 100 is formed on the outer diameter of the inner drive plate shaft 102 which is fixedly coupled to the inner drive plate 36. The rotation of the hub 16 causes the inner drive plate shaft 102 to rotate. A slotted plate shaft 106, which is fixed to the slotted plate 46 so that there is no relative angular rotation between the slotted plate and the slotted plate shaft 106, is concentrically positioned around the inner drive plate shaft 102.

A collective adjusting ring 104 having a key 104*k* that mates with the helically-shaped key slot 100 is concentrically mounted around the slotted plate shaft 106 for axial movement. Specifically, the key 104*k* is positioned through a slot 108 in the slotted plate shaft 106 and the helically shaped slot 100 to retain the collective adjusting ring 104 angularly fixed relative to the slotted plate 46. The collective adjusting ring 104 rotates along with the inner drive plate shaft 102 and the slotted plate shaft 106.

FIG. 5*a* shows a schematic view of the relationship between the collective adjusting ring 104, the inner drive plate shaft 102 and the slotted plate shaft 106. Basically, the key 104*k* keeps the inner drive plate shaft 102 and the slotted plate shaft 106 in a fixed angular phase. That is, the key 104*k* prevents the inner drive plate shaft 102 from rotating with respect to the slotted plate shaft 106. However, by axially moving the collective adjusting ring 104 along the direction X, while the collective adjusting ring rotates along with the slotted plate shaft 106 and the inner drive plate shaft 102, the relative angular position $\theta$ between the inner drive shaft 102 and the slotted plate shaft 106, and thus the relative angular position between the inner drive plate 36 and the slotted plate 46 can be changed by virtue of rotational offset in the helical slot 100.

The axial movement of the collective adjusting ring 104 is achieved by use of a pivot bracket 49 and a fork lever 112. The fork lever 112 has a forked or bifurcated end portion forming a Y-shape. The non-bifurcated end 112*a* of the lever 112 is connected to a conventional actuator 87' such as a hydraulic or pneumatic cylinder. The bifurcated end of the lever 112 is attached to a pair of bearing blocks 113, preferably water-lubricated similar to one disclosed in U.S. Pat. No. 5,028,210, one for each end of the bifurcation. The bearing blocks 113 slide in the groove 104*a* formed in the collective adjusting ring 104 to permit the collective adjusting ring to rotate relative to the bearing blocks.

The second embodiment of the present invention also uses a cyclic control mechanism substantially similar to that of the first embodiment. That is, the inner support tube 80 can be radially offset from the center line of the hub 16 to offset the slotted plate 4 and inner drive plate 36, but not disturb the angular setting between the slotted plate 46 with respect to the inner drive plate 36, thereby maintaining the same angular relationship therebetween. As a result of the offset, the slotted plate will rotate eccentrically with the hub. This eccentricity is translated to an eccentric transmission of motion from the slots in the slotted plate to the ball 25 at the end of the propeller blade crank arm 26. The eccentric motion is further translated through the crank arm 26, the propeller blade shaft 20, and into the propeller blade 18 itself. The offset position of the inner support shaft 80 controls the pitch and/or yaw pitch angles of the propeller blades. The distance of offset controls the magnitude of those angles.

Figure 4:
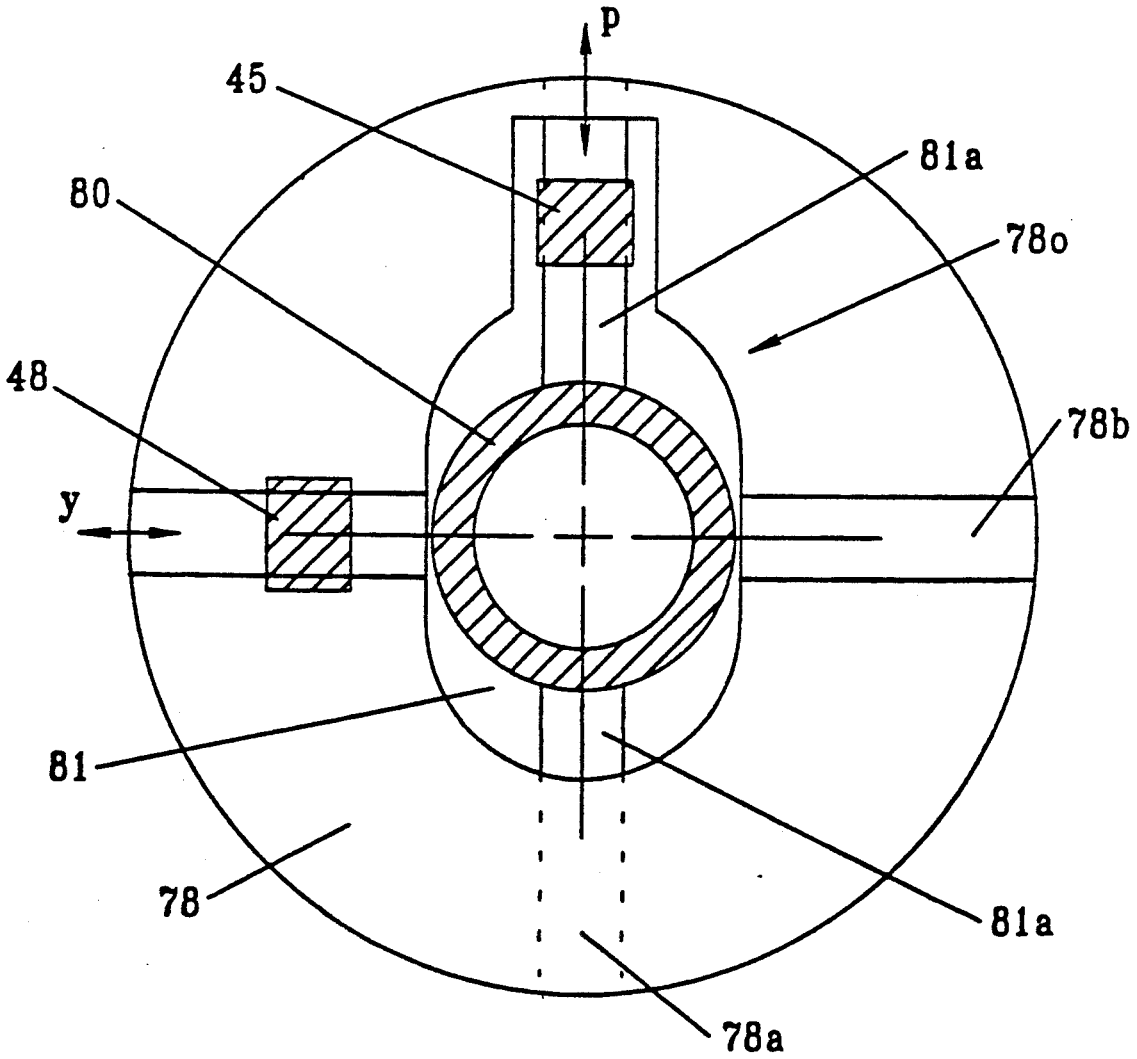
FIG. 4 is an end view (left side) of FIG. 2 showing the static Oldham coupling mechanism for controlling the cyclic pitch.

The inner support shaft 80, which is fixedly attached to the plate 81 having a key slot, supports the inner drive plate shaft 102 for rotation via the radial bearings 82. As in the first embodiment, as shown in FIG. 4, the conventional non-rotating, static Oldham ring 78 with a pair of keys 78*a*, 78*b* which are offset by 90 degrees mates with the key slot formed on the plate 75 on one side of the Oldham ring 78 and mates with the slot 81*a* of the plate 81 on the opposite side of the Oldham ring. The plate 75 is fixed to the fixed plate 70.

The plate 75, Oldham ring 78 and the plate 81 are engagingly held in place to prevent them from displacing in the axial direction by a retaining member or members 70a' which is fixedly held in place to the fixed plate 70.

As in the first embodiment, the pitch lever 45' is operatively connected to the plate 81. The yaw lever 48' which is identical to the pitch lever 45' (partially shown in phantom) is operatively connected to the Oldham ring 78 for controlling cyclic pitch changes and spaced apart from the pitch lever 45' by 90 degrees. Actuation of the pitch lever 45' moves the plate 81 which in turn moves the inner support shaft 80, along with the flat plate mechanism 36, 46, 52 to effect a pitch blade change. Actuation of the yaw lever 48' moves the Oldham ring 78, which in turn moves the plate 81, the inner support shaft 80, along with the flat plate mechanism 36, 46, 52 to effect a yaw blade change. Again, the levers 45', 48' may be actuated by any conventional motion mechanisms such as electric linear actuators with screw drives, permanent magnetic linear actuators, pneumatic or hydraulic cylinders or mechanical linkages.

MODE OF OPERATION

The pitch of the propeller blades 18 may be controlled collectively by the actuators 87 or the actuator 87' or cyclically by the levers 45, 48 or 45', 48'. When a collective pitch change is required, in which all propeller blades 18 will change in unison in the same direction, the actuators 87 and the actuator 87' cause the slotted plate 46 to rotate with respect to the inner drive plate 36 to ultimately cause the leading edge of propeller blades to move in unison fore or aft. To provide steering effect and motion perpendicular to the longitudinal axis of the propulsion unit, the pitch of the propeller blades 18 may be changed selectively. The pitch control lever 45, 45, or yaw control lever 48, 48' will offset the slotted plate 46 from the centerline of the hub. Thus, it is possible to generate a thrust vector in any of three degrees of action with this propulsion unit.

Given the disclosure of the present invention, one versed in the art would readily appreciate the fact that there can be many modifications of the present invention not specifically depicted and described, but that are well within the scope and spirit of the disclosure set forth herein. Accordingly, all expedient modifications readily attainable by one versed in the art from the disclosure set forth herein that are within the scope and essence of the present invention, are to be included as further embodiments of the present invention.

What is claimed is:

1. A marine propulsion unit for securing exteriorly to a marine hull comprising:

a ring shaped prime mover having a central axis of rotation;

a hub operatively mounted for rotation with the prime mover about the central axis;

a plurality of propulsion blades radially extending from said hub, each of said blades being capable of pivotal movement about a blade axis, whereby the pitch angle thereof is adjustable to provide pitch, yaw and fore/aft motion to said hull;

means for collectively and cyclically controlling the pitch of the blades to provide said pitch, yaw and fore/aft motion to said hull, wherein said controlling means comprises:

a first plate supported for rotation about a first axis;

a second plate rotatively coupled with said first plate for relative rotational movement about the first axis with respect to said first plate;

means for linking rotational motion from said hub to said first plate and for permitting radial movement of said inner drive plate with respect to said hub;

linkage means for connecting each of said blades with said second plate, whereupon all of said blades pivot about the blade axes when said second plate pivots with respect to said first plate;

means operatively coupled with said first and second plates for controlling the degree and direction of angular offset of said first plate with respect to said second plate to collectively control the fore/aft motion;

first plate supporting means for rotatably supporting said first plate;

means operatively coupled to said first plate supporting means for permitting said first plate supporting means and thus said first plate and said second plate to radially offset with respect to the central axis in which said hub rotates; and means for controlling the degree and direction of said radial offset of said first drive plate supporting means to provide said pitch and yaw motion.

2. A marine propulsion unit according to claim 1, wherein said first plate is an inner drive plate and said second plate is a slotted plate having radially extending slots equal in number to the number of said blades, each of said blades being operatively connected to one of said slots to cause pivoting of said blades about the blade axes.

3. A marine propulsion unit according to claim 2, wherein said first plate supporting means is a stationary inner support shaft, wherein said inner drive plate further includes an inner drive plate shaft concentrically situated over said stationary inner support shaft, radial bearings being disposed between said inner drive plate shaft and said stationary inner support shaft to permit said inner drive plate shaft and thus said inner drive plate to rotate.

4. A marine propulsion unit according to claim 3, wherein said means for linking rotational motion from said hub to said inner drive plate and for permitting radial movement of said inner drive plate with respect to said hub comprises an outer drive plate fixedly attached to said hub and a rotatable Oldham ring, whereby said outer drive plate transmits rotational force to said Oldham ring which transmits rotational force to said inner driving plate, said Oldham ring permitting radial displacement of said inner drive plate with respect to said outer drive plate upon radial offset of said stationary inner support shaft.

5. A marine propulsion unit according to claim 4, wherein said means operatively coupled to said first plate supporting means comprises a first cyclic control plate fixedly attached to said stationary inner support shaft, a static Oldham ring coupled with said first cyclic control plate and a second cyclic control plate coupled to said static Oldham ring, and a fixed frame which supports said prime mover, wherein said second cyclic control plate is fixedly attached to said fixed frame.

6. A marine propulsion unit according to claim 5, wherein said static Oldham ring includes a first key on one side thereof and a second key offset by 90 degrees opposite the one side of the Oldham ring, and wherein said first cyclic plate has a slot for mating with said first key and said second cyclic plate has a slot for mating with said second key.

7. A marine propulsion unit according to claim 6, wherein said fixed frame comprises a stationary outer support tube having a bore, wherein said means for controlling the degree and direction of said radial offset of said first drive plate supporting means is housed inside said stationary outer support tube.

8. A marine propulsion unit according to claim 7, wherein said means for controlling the degree and direction of said radial offset of said first drive plate supporting means comprises first and second levers, wherein the first lever is operatively connected to said first cyclic control plate and the second lever is operatively connected to said static Oldham ring.

9. A marine propulsion unit according to claim 6, wherein said fixed frame comprises a stationary plate, wherein said means for controlling the degree and direction of said radial offset of said first drive plate supporting means is housed outside said fixed frame and said prime mover.

10. A marine propulsion unit according to claim 9, wherein said means for controlling the degree and direction of said radial offset of said first drive plate supporting means comprises first and second levers, wherein the first lever is operatively connected to said first cyclic control plate and the second lever is operatively connected to said static Oldham ring.

11. A marine propulsion unit according to claim 6, wherein means operatively coupled with said first and second plates for controlling the degree and direction of angular offset of said first plate with respect to said second plate comprises a pair of double acting hydraulic cylinders mounted in parallel, wherein one end of each of said cylinders is pivotally mounted to said inner drive plate and the other end is pivotally mounted to said slotted plate, whereby upon actuation of one cylinder to extend and the other to contract, said slotted plate angularly rotate with respect to said inner drive plate.

12. A marine propulsion unit according to claim 6, wherein said means operatively coupled with said first and second plates for controlling the degree and direction of angular offset of said first plate with respect to said second plate comprises a helically-shaped key slot attached to an outer surface of said inner drive plate shaft; a slotted plate shaft fixedly attached to said slotted plate so that there is no relative angular rotation between said slotted plate and said slotted plate shaft, said slotted plate shaft being concentrically positioned over said inner drive plate shaft; a collective adjusting ring having a key mating with said helically-shaped key slot concentrically mounted around said slotted plate shaft for axial movement, whereby upon axial movement of said collective adjusting ring along said helically shaped key slot while said collective adjusting ring rotates along with said slotted plate shaft, the relative angular position between said inner drive plate and said slotted plate is caused to be changed by virtue of said helically-shaped slot.

13. A marine propulsion unit according to claim 12, wherein means operatively coupled with said first and second plates for controlling the degree and direction of angular offset of said first plate with respect to said second plate to collectively control the fore/aft motion comprises a lever and a linear motion actuator, wherein one end of said lever is rotatably coupled to said collective adjusting ring and the other end of said lever is connected to said linear motion actuator.

14. A marine propulsion unit according to claim 13, wherein said one end of said lever is bifurcated to contact said collective adjusting ring at two diametrically opposed positions and includes a pair of bearing blocks, one for each bifurcated end.

15. A marine propulsion unit according to claim 14, wherein said collective adjusting ring comprises a circular bearing groove formed on the outer surface thereof to permit said bearing blocks to slide therein.

* * * * *